US010473323B2

(12) United States Patent
Squashic et al.

(10) Patent No.: US 10,473,323 B2
(45) Date of Patent: Nov. 12, 2019

(54) LOADING TUBE

(71) Applicants: Brendan J. Squashic, Fremont, CA (US); Zacaria R. Oxford, Woodson Terrace, MO (US)

(72) Inventors: Brendan J. Squashic, Fremont, CA (US); Zacaria R. Oxford, Woodson Terrace, MO (US)

( * ) Notice: Subject to any disclaimer, the term of this patent is extended or adjusted under 35 U.S.C. 154(b) by 244 days.

(21) Appl. No.: 15/485,307

(22) Filed: Apr. 12, 2017

(65) Prior Publication Data

US 2017/0292694 A1 Oct. 12, 2017

Related U.S. Application Data

(60) Provisional application No. 62/321,575, filed on Apr. 12, 2016.

(51) Int. Cl.
*F22B 1/28* (2006.01)
*A24F 47/00* (2006.01)

(52) U.S. Cl.
CPC ..... *F22B 1/28* (2013.01); *A24F 47/008* (2013.01)

(58) Field of Classification Search
USPC ..... 131/194, 273; 128/202.21
See application file for complete search history.

(56) References Cited

U.S. PATENT DOCUMENTS 2,445,476 A * 7/1948 Folkman ..... A24F 47/002 131/273
8,813,759 B1 * 8/2014 Horian ..... A61M 15/06 131/273
8,997,753 B2 * 4/2015 Li ..... H01C 17/00 131/273
2004/0045566 A1 * 3/2004 Pera ..... A24D 3/048 131/334
2004/0055613 A1 * 3/2004 Horian ..... A24F 47/002 131/194
2013/0192615 A1 * 8/2013 Tucker ..... H01C 17/00 131/328
2015/0196055 A1 * 7/2015 Liu ..... A24F 47/008 131/329
2015/0208726 A1 * 7/2015 Liu ..... A24F 47/008 131/329
2015/0237915 A1 * 8/2015 Liu ..... A24D 3/043 131/329
2016/0095354 A1 * 4/2016 Wu ..... A24F 47/008 131/329

OTHER PUBLICATIONS

MistHub "Tutorial Atomizer vs. Cartonnizer vs. Clearonnizer". 101 Electronic Cigarette. (Year: 2013).*

* cited by examiner

*Primary Examiner* — Nina Bhat
(74) *Attorney, Agent, or Firm* — Charles McCloskey

(57) ABSTRACT

A loading tube has Japanese cotton placed within a polymer tube. The tube has a hollow, cylindrical form with a tip and an opposite tail. The Japanese cotton advances through the tube exiting at the tip and withdrawing from the tail. The tube has a sidewall with a thickness and an inner diameter suitable for containing Japanese cotton and then advancing it into an atomizer. The outer diameter of the tube cooperates with an aperture in the coil of the atomizer. The tip and the tail have a rim with a square cut. The tube has its size that relates its length to its inner diameter, and to its thickness within a range. The tube utilizes polypropylene for its construction. Alternative fibrous material may be substituted for Japanese cotton.

3 Claims, 2 Drawing Sheets

LOADING TUBE

CROSS-REFERENCE TO RELATED APPLICATION

This non-provisional application claims priority to pending provisional application No. 62/321,575 filed on Apr. 12, 2016, all of which are owned by the same inventor.

BACKGROUND OF THE INVENTION

The present invention relates generally to vaping and, more particularly to a tool for placing cotton into a vaping machine. The present invention is a quickwick of compressed cotton, or other fiber, contained within a tube, often of plastic, for use in the vaping industry.

Not long after Columbus reached the New World, various explorers and merchants brought tobacco back to Europe. Europeans of all social strata took a liking to tobacco in various forms. In the centuries since, people have smoked tobacco, chewed tobacco, made tobacco into a pumice, eaten tobacco, and the like. Various governments have also taken a liking to revenues produced by tobacco. Corporations have made sizeable fortunes from the cultivation, transportation, manufacturing, and distribution of tobacco. Tobacco appears in a host of products from tins of chew through cigarettes to a Lonsdale parejeo and beyond to Jose Castelar Cueto's 2011 gigante over 200 feet.

However, tobacco products underwent medical and scientific testing. By the mid 1970s, tobacco products acquired the label carcinogenic. Tobacco found itself at the root of lung cancer along with others. Users of tobacco, governments, and industry have worked out various compromises since then. The latest compromise was the tobacco master settlement of 1998 with the States Attorneys General and the tobacco industry. The settlement curtailed tobacco advertising immensely and directed multibillion dollar sums towards state governments. The tobacco industry remains operating today with noticeable profits upon domestic and foreign products.

Meanwhile, as Europeans travelled easterly beyond the Middle East, the hookah developed upon the Indian subcontinent. The hookah passes smoke from burning tobacco through water ostensibly to purify it. The hookah then collects the cleansed smoke for distribution through tubes to a user. A hookah may also be called a water pipe. Hookahs have acquired various shapes, geometries, and ornamentation reflecting the wealth and social status of the owner. People smoke using the hookah through the Middle East, South Asia, parts of Africa, and select establishments in other parts of the world.

Having cleansed tobacco smoke through water, a hookah though still emits smoke having the addictive properties of tobacco. Hookah smoking faces government regulation in various parts of the world.

Though the preceding background refers to tobacco, various cultures around the world have smoked other plant products for millennia. The devices is for smoking those other plants also stimulated development of tobacco smoking technology and hookah devices. Some plant products have escaped government regulation while others remain prohibited by other government regulation.

DESCRIPTION OF THE PRIOR ART

Subject to an abundance of government regulation, the tobacco industry has sought alternative products. In recent years, the tobacco industry has taken partial inspiration from the hookah and developed electronic cigarettes, or e-cigs. An electronic cigarette receives a nicotine containing liquid into a reservoir. The user, called a vaper, then presses a switch and the electronic cigarette heats the liquid. Based upon ambient temperature and pressure, the heated liquid then emits vapors into a tubular handle upon which a vaper inhales. The depressurized tubular handle then draws the vapors into the mouth, throat, and then the lungs of the vaper for absorption and effect upon the vaper.

Vapers report similar positive effects upon their bodies and psyche as tobacco smoking but with less contamination from smoke byproducts. Various governments have started to regulate electronic cigarettes and the vaping industry. The regulations have a patchwork form at present.

More particularly, in the vaping industry, suppliers and vapers themselves use a rebuildable atomizer that utilizes cotton as a wicking material to produce vapor. During usage of an atomizer, a vaper threads or inserts by hand cotton into a ring of metal coils. A vaper may have used specific tools, such as scissors, tweezers, and the like, and spend upwards of five minutes to re-wick a vaping device. The vaper then introduces e-liquid upon the cotton to saturation. The e-liquid includes select food grade flavorings dissolved or emulsified within a solvent. The vaper then presses a switch upon the rebuildable atomizer which releases electrical power from a battery to heat the coils. Contact of the e-liquid saturated cotton upon the heated metal coils produces vapor. The atomizer then collects the vapor and a vaper inhales it using a tubular handle or flexible tube like member.

SUMMARY OF THE INVENTION

The present invention, or quickwick, has compressed cotton contained within a plastic tube. The present invention receives organic Japanese cotton inserted and compressed into a tube of polypropylene. The tube has an outer diameter of three millimeters or 3 mm, an inner diameter of 2.7 mm, and a length of 17.5 mm. These dimensions are exemplary and may vary. The Applicant foresees multiple variations of the present invention through usage of varying dimensions in the length, inner diameter, and outer diameter of the tube, and the materials of the tube. The Applicant foresees a length from about 15 mm to about 50 mm. Further, the tube of the invention avoids a vaper placing skin oils upon the organic Japanese cotton.

The present invention has Japanese cotton placed within a polymer tube. The tube has a hollow, cylindrical form with a tip and an opposite tail. The Japanese cotton advances through the tube exiting at the tip and withdrawing from the tail. The tube has a sidewall with a thickness and an inner diameter suitable for containing Japanese cotton and then advancing it into an atomizer. The outer diameter of the tube cooperates with an aperture into the coils of the atomizer. The material of the tube minimizes friction and contact with the coils during usage of the invention. The tip and the tail have a rim preferably square end. The tube has its size relating its length to its inner diameter, and to its thickness within a range.

There has thus been outlined, rather broadly, the more important features of the invention in order that the detailed description thereof that follows may be better understood and that the present contribution to the art may be better appreciated. The invention also has the rims of the tip and of the tail in alternate round, ogee, or knife edge end conditions, the tube of polypropylene with coefficient of friction within a range, and variation in length. And additional features of the invention will be described hereinafter and which will form the subject matter of the claims attached.

Numerous objects, features and advantages of the present invention will be readily apparent to those of ordinary skill in the art upon a reading of the following detailed description of the presently preferred, but nonetheless illustrative, embodiment of the present invention when taken in conjunction with the accompanying drawings. Before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, the phraseology and terminology employed herein are for the purpose of description and should not be regarded as limiting.

One object of the present invention is to provide a loading tube that provides the vaping consumer an efficient method of inserting cotton into a rebuildable atomizer.

Another object is to provide such a loading tube that a consumer inserts into an atomizer as the loading tube contains preloaded compressed cotton.

Another object is to provide such a loading tube that a consumer inserts into a ring of metal coils within an atomizer.

Another object is to provide such a loading tube that a consumer removes from a ring of metal coils leaving the cotton behind in the atomizer so that it expands within the ring of metal coils.

Another object is to provide such a loading tube that a disabled person may manually insert and remove readily.

Another object is to provide such a loading tube that allows a vaper to re-wick an atomizer within 10 seconds and without tools.

Another object is to provide such a loading tube that allows a vaper without the necessary hand dexterity required to manually re-wick at atomizer with prior art methods may do so readily with the invention.

Another object is to provide such a loading tube that has a low cost of manufacturing so the purchasing vapers, vape shops, suppliers, vendors, and warehouses can readily buy the loading tube through supply houses, catalogs, and select stores.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

In referring to the drawings.

The same reference numerals refer to the same parts throughout the various figures.

DESCRIPTION OF THE PREFERRED EMBODIMENT

The present invention overcomes the prior art limitations by providing a loading tube for inserting wick into an atomizer. The invention allows a user, or a vaper, to insert the wick with a minimum of training and skill.

Figure 1:
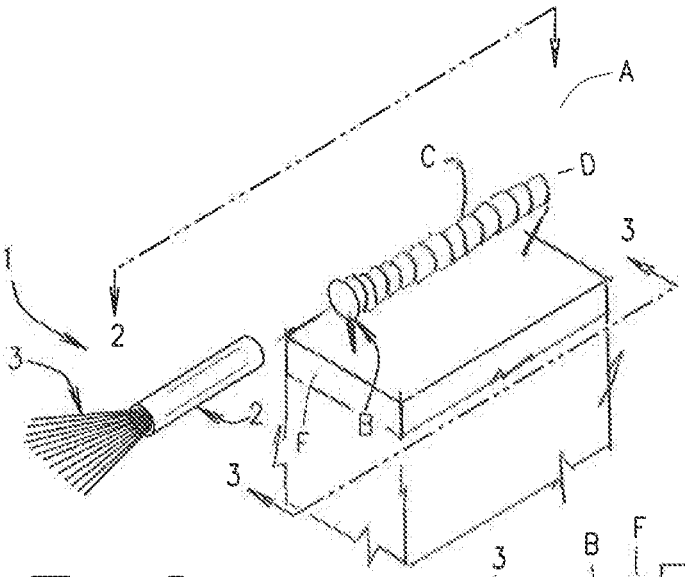
FIG. 1 is a perspective view of the present invention proximate an atomizer.

Turning to FIG. 1, the loading tube of the present invention appears as at 1 outwardly from an atomizer A. The invention's tube 2 has a portion of wick 3 extending rearwardly. The wick began in strip form with a length of 4 centimeters, "cm." The strip of the wick has sizes of 7.5 millimeters, "mm," 9.5 mm, 13 mm, 16 mm, and 18 mm that correspond to tube outer diameters of 2.5 mm, 3.0 mm, 3.5 mm, 4.0 mm, and 4.5 mm respectively. The atomizer has a face F that presents outwardly to a vaper about to insert the invention for re-wicking of the atomizer. Generally oriented above the atomizer and perpendicular to the face, the atomizer has a coil C. The coil has an elongate form of a material suitable for electrical induction heating. The atomizer contains the electrical circuitry, battery, and controls for operation, not shown. The coil has a generally round aperture B upon one end that leads inwardly into it for introduction of e-liquid therein. The coil's aperture B receives the invention 1 during usage by a vaper. The aperture has a generally round shape sized to admit the tube 2 in an axial manner. The tube fits snugly into the aperture but yet permits withdrawal of the tube leaving wick 3 behind in the coil that draws and receives e-liquid into it during usage.

Figure 2:
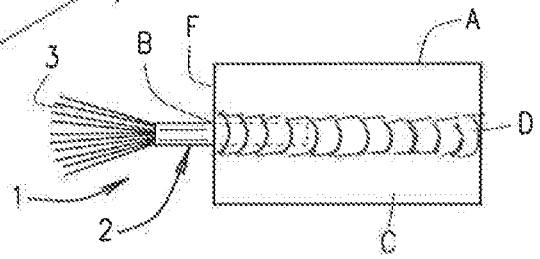
FIG. 2 is a top view of the invention inserted into an atomizer.

More particularly shown from a top view in FIG. 2, the atomizer A has the coil C with its aperture B that receives the invention 2 and then admits the wick 3 into it. Opposite the aperture B, the coil C has an exit D. The invention 1 enters the aperture B here shown to the left. The Applicant though foresees the coil and the atomizer having various shapes and configurations. The tube 2 enters the aperture B, extends into the coil C, and reaches to the exit D. The tube has its length that permits a vaper to position into the aperture and then push it into the coil and pull off the tube at the exit D. After removing the tube from the coil, the vaper triggers the coil to heat through electrical induction.

Figure 3:
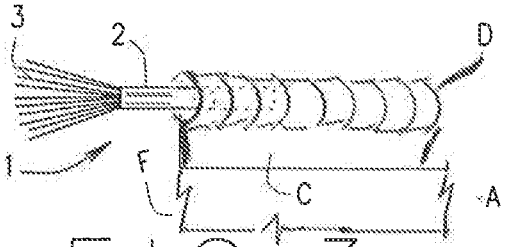
FIG. 3 is a side view of the invention inserted into an atomizer.

With the invention positioned proximate the coil C, FIG. 3 shows the atomizer in a side view. The tube 2 nears the coil and allows a vaper to advance the wick towards into coil C here shown extending upwardly from the atomizer upon two legs. Having positioned the wick into the coil, the vaper carefully withdraws the tube 2 through the exit D from the coil while leaving the wick 3 behind in the coil. The vaper then wets the wick from an e-liquid source, such as a vial, a jar, or a tube (not shown). With the wick wet to the vaper's taste, the vaper then triggers the coil to heat and vaporize the e-liquid for inhalation.

Figure 4:
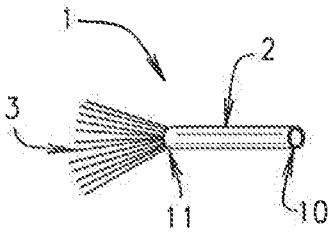
FIG. 4 is a side view of the present invention.

Turning to the invention 1 alone, FIG. 4 shows the invention from the side. The tube 2 has a generally elongated hollow form with a tip 10 and an opposite tail 11. The wick 3 extends outwardly from the tail 11 while no wick extends from the tip, here shown to the right. The wick has a generally fibrous form suitable for drawing e-liquid by capillary action from its source and into the wick. In the preferred embodiment, the wick is Japanese cotton of the species *Gossypium herbaceum*. In an alternate embodiment, the wick is of braided cotton or flat braided cotton. In an alternate embodiment, the wick also includes a strand of fine wire. In an alternate embodiment, the wick has a treatment of mordanting that maintains its liquid capillary action during combustion of the wick at the coil C. Mordanting includes the application of salt and of borax in solution form to the wick.

A vaper positions the tube 2, as shown in FIG. 4, with the tip 10 forward and towards the atomizer during usage as previously described. The wick extends outwardly from the tail and the atomizer as shown to the left.

Figure 5:
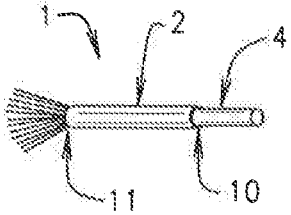
FIG. 5 is a side view of the invention with wick partially inserted.

With the tube placed into the aperture as previously described, the vaper advances the wick 3 into the tube 2 as shown in FIG. 5. The wick extends outwardly from the tip 10 as a round, extensible lead 4 that approaches a coil C during usage. Opposite the lead, the wick 3 narrows and gathers as it approaches the tail 11. The wick advances as a vaper twists, pushes, or otherwise manipulates the wick to enter the tube 2. The vaper then inserts the tip 10 first into the aperture B of the coil C. And, the vaper slowly withdraws the tube 2 from the coil as the lead 4 enters further into the atomizer.

Figure 6:
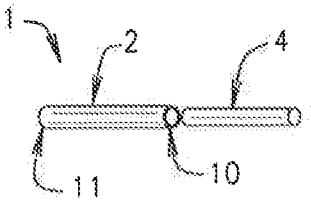
FIG. 6 is a side view of the invention with wick fully extended.

FIG. 6 shows the invention 1 with the tube 2 nearly removed from the wick 3 and its lead 4 nearly fully extended to the right. The lead may extend its length for multiples of its diameter. Here, the tip 10 has the lead of the wick while the tail 11 has an absence of wick 3. The vaper removes the tube 2 carefully from the wick 3 using his fingers but not touching the wick and not imparting any skin oils or other contaminants to the wick.

Figure 7:
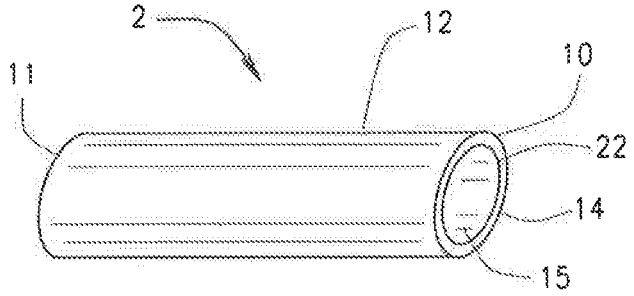
FIG. 7 is a perspective view of the invention.

Turning to the tube itself, FIG. 7 shows a side perspective view of the tube 2 with the tip 10 towards the right. Because a vaper uses manual effort to extend the lead, the wick must slide readily from the tube and the tube must slide readily out of an atomizer. The Applicants have selected a tube having a coefficient of friction between about 0.1 to about 0.3 with the wick and with various metals suitable for an atomizer. In the preferred embodiment, the tube is polypropylene such as from Goodfellow, Inc. of Coraopolis, Pa. The tube 2 has a hollow cylindrical form made of a sidewall 12 that has a thickness 13, later shown in FIG. 11. The tube also has an outer diameter and an inner diameter smaller than the outer diameter. At the tip 10, the thickness defines a rim 14. The rim occupies a plane generally perpendicular to the sidewall 12. Inwardly from the rim 14 at the tip 10, the tube has an inner wall 15 and the wick passes along the inner wall as it travels through the tube during usage.

Figure 8:
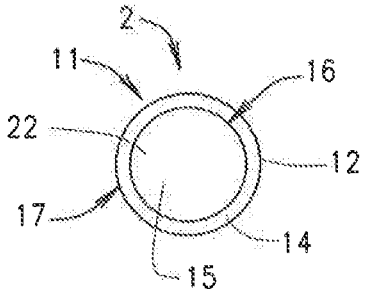
FIG. 8 is an end view of the invention.

Turning the tube 2, FIG. 8 shows an end view with the tail 11 in the foreground. The tail includes a rim 14 here shown as flat and parallel to the plane of this figure. The rim has a width similar to that of the thickness 13 of the sidewall. The rim extends from the inner wall 15 outwardly to the sidewall, that is, the exterior of the sidewall. The rim begins at an inner edge 16 where the inner wall terminates and extends to an outer edge 17 where the sidewall terminates. The inner edge defines an opening 22 into which the fibrous material 3 or Japanese cotton inserts. Typically, the inner edge and the outer edge occupy the same plane, that of the rim.

Figure 9:
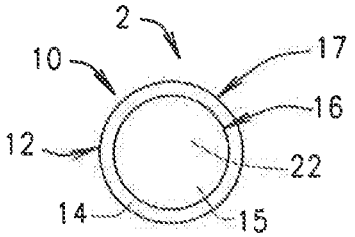
FIG. 9 is an end view of the invention.

Opposite FIG. 8, FIG. 9 describes another end view with the tip 10 in the foreground. The tip also has a rim 14 also flat and in the plane of this figure. The rim has its width defined by that of the thickness 13 of the sidewall. The rim extends from the inner wall 15 outwardly to the sidewall, that is, the exterior of the sidewall. The rim begins at an inner edge 16 where the inner wall terminates and extends to an outer edge 17 where the sidewall terminates. Here, the inner edge defines another opening 22 from which the fibrous material 3 or Japanese cotton ejects as a lead as previously shown. Typically, the inner edge and the outer edge occupy the same plane, that of the rim.

Figure 10:
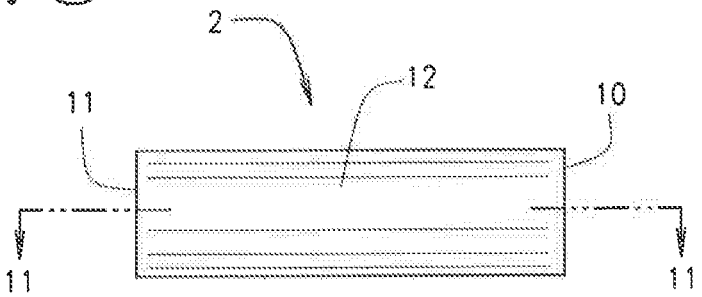
FIG. 10 is a side view of the invention.

Turning the tube once more, FIG. 10 shows a top view of the tube 2. Because the tube is symmetric and round, this view also shows the sides and bottom of the tube. The tube has its form from the sidewall 12 wrapped into a cylinder though here appearing as a rectangle. The sidewall extends from the tail 11 to the tip 10. As mentioned above, the tip inserts into an aperture of an atomizer while the tail passes upon the wick during withdrawal of the tube by a vaper.

Figure 11:
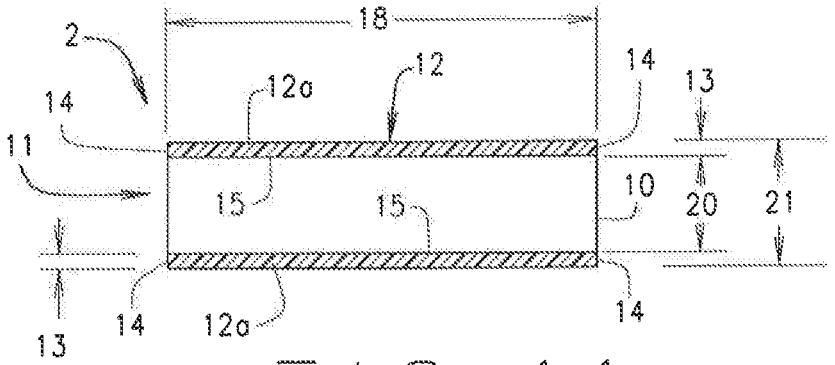
FIG. 11 is a sectional view of the invention.

Looking more closely at the tube 2, FIG. 11 displays the tube in a sectional view with the sidewall 12 shown in two mutually parallel and spaced apart rectangles as at 12*a*. Each rectangle shown has the inner wall 15 here shown as two mutually parallel and spaced apart surfaces interiorly from the sidewall 12. Each rectangle, of the sidewall, has the tail 11 to the left of this figure and the tip 10 to the right of this figure. Each rectangle has an end at the tip, generally square, that forms the rim 14. A square edge has the inner edge 16 and the outer edge 17 at each rim 14 generally in the same plane. Then each rectangle has an opposite end at the tail, generally square as well that also forms the rim 14. Each rectangle has a length, as at 18, also the length of the entire tube. Each rectangle has its thickness 13 generally extending from the inner wall outwardly to the sidewall and forming the tube as previously shown. The spacing of the two rectangles as shown defines an inner diameter of the tube, as at 20 and the inner diameter plus two thicknesses 13 defines an outer diameter of the tube, as at 21. The length 18 has a ratio to the outer diameter 21 of from about 4 to about 25. Then the length 18 has a ratio to the thickness 13 of from about 40 to about 180.

The tube has an outer diameter of about 3 mm, an inner diameter of about 2.7 mm, and a length from about 15 mm to about 50 mm. The Applicants foresee a preferred length of about 16 mm to about 50 mm with a desired length of 17.5 mm.

Meanwhile, the inner wall 15 adjoins the wick 3 inserted into the tube 2 for usage by a vapor. The inner wall has a low profile roughness factor, $R_a$, so that the wick inserts readily into the tube and later the tube readily removes from the wick. The profile roughness factor represents the smoothness of the inner wall. More particularly, the profile roughness factor results from the arithmetic average of absolute values of surface height of the inner wall from a mean height. The profile roughness factor presents a generally smooth inner wall and ranges from about $300\times10^{-6}$ to about $80\times10^{-6}$. The smoothness of the inner wall has a contributing factor from the porosity of its material, preferably polypropylene. The porosity becomes important following extrusion of the tube during its manufacturing. Less porosity leads to a smooth inner wall. Less porosity here generally has less than 5 pores per centimeter, a pore size less than 50 microns, and porosity less than 10% by area.

From the aforementioned description, a loading tube has been described. The loading tube is uniquely capable of containing Japanese cotton within it, then ejecting the Japanese cotton into a lead from its tip, and then slipping off the Japanese cotton through its tail. The loading tube deploys the Japanese cotton into the aperture of an atomizer with minimum vaper effort and skill. Further, the loading tube may also have variations in length, wall thickness, diameter, end condition, and other related features compatible with the structure and purpose of the invention as shown and described. The loading tube and its various components may be manufactured from many materials, including but not limited to, vinyl, polymers, such as nylon, polypropylene, polyvinyl chloride, high density polyethylene, polypropylene, ferrous and non-ferrous metal foils, their alloys, and composites.

Various aspects of the illustrative embodiments have been described using terms commonly employed by those skilled in the art to convey the substance of their work to others skilled in the art. However, it will be apparent to those skilled in the art that the present invention may be practiced with only some of the described aspects. For purposes of explanation, specific numbers, materials and configurations have been set forth in order to provide a thorough understanding of the illustrative embodiments. However, it will be apparent to one skilled in the art that the present invention may be practiced without the specific details. In other instances, well known features are omitted or simplified in order not to obscure the illustrative embodiments.

Various operations have been described as multiple discrete operations, in a manner that is most helpful in understanding the present invention, however, the order of description should not be construed as to imply that these operations are necessarily order dependent. In particular, these operations need not be performed in the order of presentation.

Moreover, in the specification and the following claims, the terms "first," "second," "third" and the like—when they appear—are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to allow the reader to ascertain the nature of the technical disclosure. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment. The scope of the invention should be determined with reference to the appended claims, along with the full scope of equivalents to which such claims are entitled.

As such, those skilled in the art will appreciate that the conception, upon which this disclosure is based, may readily be utilized as a basis for the designing of other structures, methods and systems for carrying out the several purposes of the present invention. Therefore, the claims include such equivalent constructions insofar as they do not depart from the spirit and the scope of the present invention.

We claim:

1. A method of delivering a wick into vaping equipment, the vaping equipment having a coil, comprising:

providing a hollow, elongated tube having a tip and an opposite tail, said tip being spaced ahead of said tail;

placing a wick into said tail and leaving a portion of the wick outwardly from said tail;

orienting said tip towards the coil of the vaping equipment;

inserting said tip into the coil;

pushing said tube through the coil leaving the wick behind thus delivering the fibrous material into the coil; and, withdrawing said tube from the vaping equipment.

2. A device delivering a wick into vaping equipment, comprising:

a tube, generally hollow, elongated and round, having a length and an outer diameter;

said tube having a sidewall, a tip, an opposite tail, and an inner wall generally concentric with said sidewall, said inner wall being spaced inwardly by said thickness, said tip being spaced ahead of said tail, said tip is adapted to insert into the vapinq equipment;

said sidewall having a thickness imparting rigidity to said device;

said tube said tip having a rim and said tail having a rim, each of said rims occupying a plane perpendicular to the length of said tube, each of said rims having a width defined by said thickness of said sidewall, an outer edge, and an inner edge spaced inwardly from said outer edge, said inner edge extending from said inner wall;

each of said rims being square wherein said outer edge and said inner edge of each of said rims occupy a common plane perpendicular to said length;

wherein said inner wall has a coefficient of friction from about 0.1 to about 0.3;

wherein said length has a ratio to said thickness of about 40 to about 600 and said length has a ratio to said outer diameter of about 4 to about 12; and, wherein said device is adapted to admit a wick into said tail and then is adapted to deliver the wick from said tip into the vaping equipment.

3. The device delivering a wick of claim 2 wherein said wick is Japanese cotton and said tube is polypropylene; and, wherein said inner wall has a profile roughness factor from about $300\times10^{-6}$ to about $80\times10^{-6}$ and porosity less than 10% by area.

* * * * *